US007493877B2

(12) United States Patent
Broadway et al.

(10) Patent No.: US 7,493,877 B2
(45) Date of Patent: Feb. 24, 2009

(54) WATER TANK JACKETS AND RELATED METHODS

(75) Inventors: Michael James Broadway, 7413 Ambassador Crescent, Whistler, BC (CA) V0N 1B7; Larry Kent Broadway, Whistler (CA)

(73) Assignee: Michael James Broadway, Whistler (CA)

( * ) Notice: Subject to any disclaimer, the term of this patent is extended or adjusted under 35 U.S.C. 154(b) by 121 days.

(21) Appl. No.: 11/458,647

(22) Filed: Jul. 19, 2006

(65) Prior Publication Data

US 2008/0017135 A1 Jan. 24, 2008

(51) Int. Cl.
*F24H 9/02* (2006.01)

(52) U.S. Cl. ..... 122/19.2; 220/694.1

(58) Field of Classification Search ..... 122/19.2, 122/494; 126/344; 220/567.3, 694.1
See application file for complete search history.

(56) References Cited

U.S. PATENT DOCUMENTS

| | | | | |
|---|---|---|---|---|
| 2,371,347 | A | 3/1945 | Morrow | |
| 3,863,694 | A | 2/1975 | Fisher | |
| 3,906,129 | A * | 9/1975 | Damois | 428/99 |
| 4,765,360 | A | 8/1988 | Baird | |
| 4,844,286 | A | 7/1989 | Jacobson | |
| 5,190,089 | A * | 3/1993 | Jackson | 150/165 |
| 5,289,858 | A * | 3/1994 | Grabenkort | 141/97 |
| 5,379,810 | A * | 1/1995 | Marino | 141/10 |
| 5,609,265 | A * | 3/1997 | Haberkorn et al. | 220/694 |
| 5,677,026 | A * | 10/1997 | Santoli | 428/76 |
| 5,711,632 | A | 1/1998 | Garrahan | |
| 5,794,609 | A | 8/1998 | Grant | |
| 5,857,482 | A | 1/1999 | Dowling | |
| 5,865,223 | A * | 2/1999 | Cornford | 141/88 |
| 6,084,520 | A | 7/2000 | Salvucci | |
| 6,135,133 | A | 10/2000 | Ridgeway, Jr. | |
| 6,276,309 | B1 | 8/2001 | Zeek | |
| 6,532,907 | B1 | 3/2003 | Harrison | |

FOREIGN PATENT DOCUMENTS

| | | |
|---|---|---|
| CA | 2187824 | 4/1998 |
| CA | 2235040 | 1/2004 |
| CH | 671207 | 8/1989 |
| DE | 9015532 U | 1/1991 |

* cited by examiner

*Primary Examiner*—Gregory A Wilson
(74) *Attorney, Agent, or Firm*—Oyen Wiggs Green & Mutala LLP

(57) ABSTRACT

A jacket for a water tank comprises a sheet of water-containing material such as plastic. A closure is provided to draw together two opposed edges of the sheet. A fastener, such as a strap clamp extends along a third edge of the sheet. The jacket may be retrofitted to an existing tank, such as a domestic hot water tank, by clamping the fastener around a drain pan under the tank and closing the closure so that the jacket wraps around the tank. Any water leaking from the tank is caught by the jacket and directed into the drain pan from where it can escape safely into a drain.

31 Claims, 5 Drawing Sheets

WATER TANK JACKETS AND RELATED METHODS

TECHNICAL FIELD

This invention relates to jackets for water tanks and, in particular, to jackets for reducing the spread of water escaping from failed water tanks.

BACKGROUND

Tank-type water heaters of the type used in many North American homes and businesses have a limited lifespan. Over time, a water tank can corrode to the point that it is no longer water tight. It is not uncommon for water heater tanks to leak, rupture or otherwise fail. Other water tanks may fail in a similar manner.

When a water tank fails, water escapes. The escaping water may cause extensive damage to building structures or other items in the environment surrounding the water tank. Damage may be especially great if the water tank is on an upper floor of a building since escaping water can flow downward to damage lower floors.

Plumbing codes typically call for a floor drain to be installed in the vicinity of a hot water tank. However, if a water tank ruptures in such a manner that water sprays out sideways or if there is a large leak in the water tank, much of the escaping water may fail to enter the floor drain.

There is a need for a practical and cost-effective way to prevent water escaping from a leaking water tank from damaging building structures and items surrounding the water tank.

Some examples of prior art are:

CA 2187824 discloses a drain pan that can be slid under a water heater to collect leaking water.

CA 2235040 discloses a bag for enclosing the lower portion of a residential heating oil reservoir.

U.S. Pat. No. 2,371,347 discloses a jacket for water heaters.

U.S. Pat. No. 4,765,360 discloses a water heater leak collector having a collector base that provides a wall surrounding a base of a water heater.

U.S. Pat. No. 4,844,286 discloses a covering for containment of leakage of toxic chemicals from heavy drums.

U.S. Pat. No. 5,711,632 discloses a device for containing leaks or spills of possibly hazardous or other wise harmful chemical substances contained in containers such as chemical drums.

U.S. Pat. No. 5,794,609 discloses a water heater overflow prevention system having an overflow pan that catches water overflowing from a water heater.

U.S. Pat. No. 5,857,482 discloses a system for controlling overflows of fluid vessels. The system includes a housing that surrounds a vessel to define a collection chamber. A liquid detector is provided in the collection chamber.

U.S. Pat. No. 6,084,520 discloses a leak collector and supply shut-off system for closing of the supply of water and energy to a water heater in the event of a leak.

U.S. Pat. No. 6,135,133 discloses a containment wall that may be assembled around a water heater. An alarm may detect water that has leaked from the water heater and is within the containment wall.

U.S. Pat. No. 6,532,907 discloses an expandable jacket for at least partially enclosing a liquid storage vessel.

U.S. Pat. No. 6,276,309 discloses a system for holding detecting and removing water that has leaked from a hot water heater. The device also shuts of a water supply to the water heater.

CH 671207 discloses a bag for enclosing a damaged container.

The foregoing examples of the related art and limitations related thereto are intended to be illustrative and not exclusive. Other limitations of the related art will become apparent to those of skill in the art upon a reading of the specification and a study of the drawings.

SUMMARY

The following embodiments and aspects thereof are described and illustrated in ways which are meant to be exemplary and illustrative, not limiting in scope. In various embodiments, one or more of the above-described problems have been reduced or eliminated, while other embodiments are directed to other improvements.

One aspect of the invention provides a jacket for a water tank. The jacket comprises a sheet of water-containing material, a closure extending along opposed first and second edges of the sheet, and a fastener extending along a third edge of the sheet, the third edge extending between the first and second edges. The fastener is operable to fasten the third edge of the sheet to a drain pan below the water tank.

Another aspect of the invention provides a method for installing a jacket for a water tank. The method comprises wrapping a sheet made of a water-containing material around a water tank, closing a closure extending along opposed first and second edges of the sheet, and fastening a third edge of the sheet, the third edge extending between the first and second edges, to a drain pan below the water tank using a fastener. The method may also comprise tightening a drawstring extending along a fourth edge of the sheet, the fourth edge opposed to the third edge of the sheet.

Further aspects of the invention and features of specific embodiments of the invention are described below.

BRIEF DESCRIPTION OF DRAWINGS

Exemplary embodiments are illustrated in the attached drawings. The embodiments and figures disclosed herein are illustrative and not restrictive.

DESCRIPTION

Throughout the following description specific details are set forth in order to provide a more thorough understanding to persons skilled in the art. However, well known elements may not have been shown or described in detail to avoid unnecessarily obscuring the disclosure. Accordingly, the description and drawings are to be regarded in an illustrative, rather than a restrictive, sense.

This invention provides jackets that can be installed around hot water heaters and other water tanks. The jackets are made of material that is either waterproof (i.e. substantially impervious to water) or at least substantially water resistant (i.e. the material will block a jet of water although water may seep through it over time). Such materials are described as "water-containing" materials herein.

Figure 1:
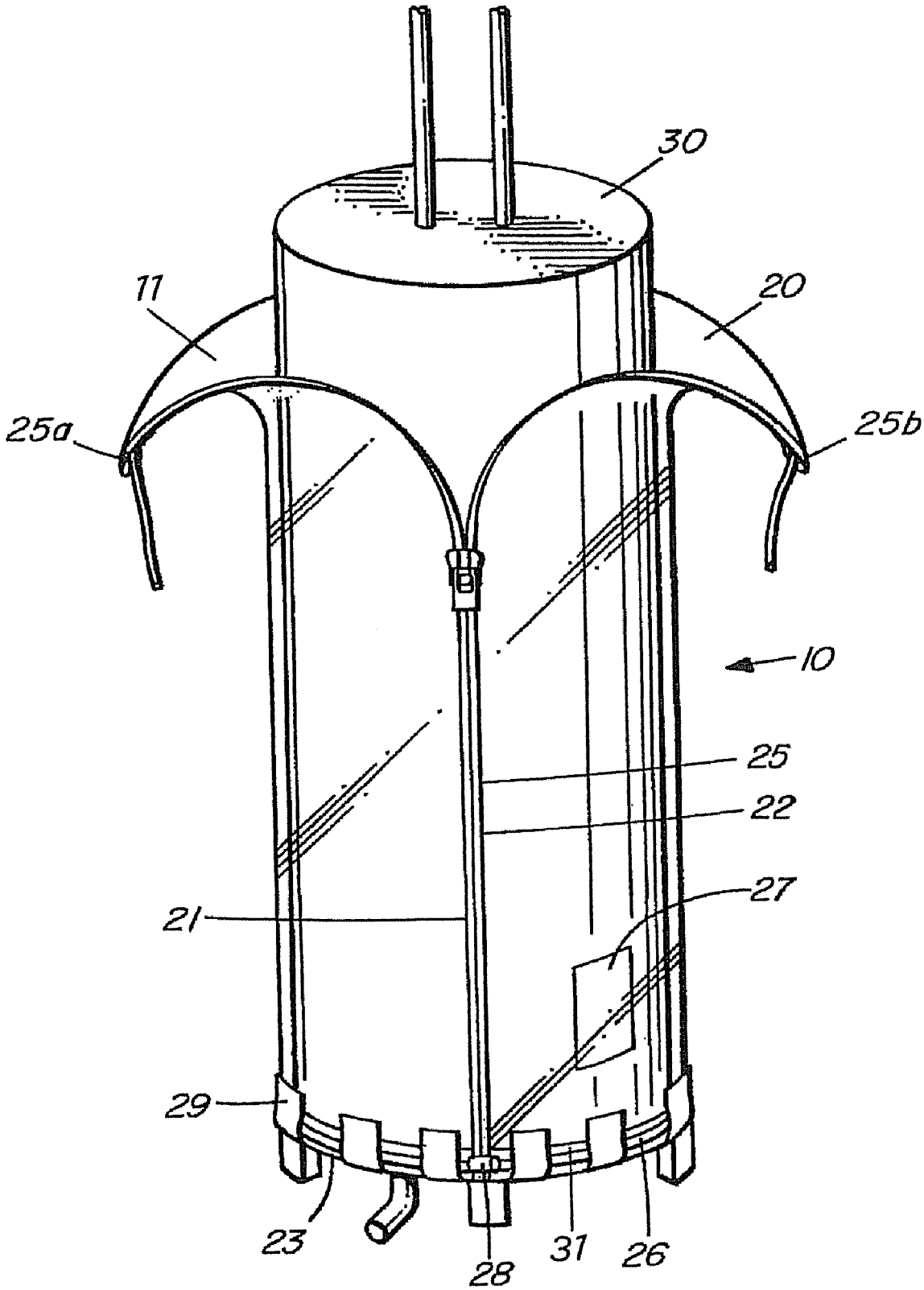
FIG. 1 is a perspective view of a jacket according to one embodiment of the invention being installed about a water tank.

FIG. 1 illustrates a jacket 10 for a water tank 30 in accordance with a particular embodiment of the invention. Jacket 10 comprises a sheet 11 of water-containing material 20 that can be wrapped around water tank 30. Sheet 11 is generally rectangular in the illustrated embodiment. A closure 25 joins opposed first and second edges 21 and 22 of sheet 11. Jacket 10 also comprises a fastener 26 extending along a third edge 23 of sheet 11. Third edge 23 extends between first edge 21 and second edge 22. Third edge 23 has a length that is equal to or slightly larger than the perimeter of water tank 30 (i.e. the circumference of water tank 30 where water tank 30 is cylindrical as shown).

Fastener 26 is operable to fasten third edge 23 around the circumference of a drain pan 31 below water tank 30.

If water tank 30 leaks, ruptures or otherwise fails, jacket 10 channels escaping water into the drain pan and reduces the escape of water from water tank 30 to the environment surrounding water tank 30. Ideally, material 20 is waterproof, that is, sheet 11 is made of a material having a hydrostatic head greater than 1000 mm $H_2O$. However, the invention can be practised with a sheet whose capacity to contain water is significantly less. It can be appreciated any material which impedes the progress of water will reduce the escape of water from water tank 30 to the environment surrounding tank 30.

Sheet 11 may be made of any one of, or any suitable combination of, a wide variety of water-containing materials. Non-limiting examples of such materials include:

- plastic,
- vinyl,
- polyethylene,
- polypropylene,
- polyvinyl chloride,
- suitable Kevlar™ fabrics,
- rubber,
- nylon,
- waterproof, breathable fabrics such as Goretex™,
- coated fabrics,
- tightly-woven textiles, such as canvass,
- any other suitable material whether now known or developed in future, and
- the like.

The material(s) of sheet 11 is preferably fire resistant. In some embodiments, sheet 11 is transparent or comprises an area 27 that is transparent or translucent such that features of water tank 30 and water contained between sheet 2-0- 11 and water tank 30 are visible to an observer. For example, if sheet 11 is not made of a transparent material, sheet 11 may comprise a window of a transparent material located in a position such that the window will be adjacent to a plate containing information such as the model and serial number of the water heater when jacket 10 is installed around the water tank.

In the embodiment shown in FIG. 1, closure 25 extends along first edge 21 and opposed second edge 22. In the particular embodiment shown in FIG. 1, closure 25 comprises a first closure element 25A attached to and extending along first side 21 and a mating second closure element 25B attached to and extending along second side 22. In the illustrated embodiment, first closure element 25A and second closure element 25B comprise cooperating components of a zipper fastener.

A wide variety of alternative closure types may be used for closure 25. Non-limiting examples of such closures include:

- loop and hook fasteners such as Velcro™;
- zipper fasteners,
- magnetic fasteners,
- buttons and button holes hole,
- belts and buckles,
- snap fasteners,
- staples,
- clips or clamps,
- adhesives, and
- the like.

Those skilled in the art will also appreciate that closure 25 may be achieved without additional closure elements by making edges 21 and 22 of sheet 11 of a material or materials such that first edge 21 and second edge 22 are amenable to coupling by rolling, folding or the like. Those skilled in the art will further appreciate that closure 25 may comprise a closure element that is initially attached to only one of first and second edges 21 and 22 and is adapted to be attachable to the other one of edges 21 and 22. For example, the closure element could comprise a strip of a suitable adhesive. Closure 25 is preferably water-containing when closed.

FIG. 1 shows fastener 26 fastening third edge 23 of sheet 11 to a drain pan 31 below water tank 30. In the particular embodiment illustrated in FIG. 1, fastener 26 comprises a band clamp having a worm gear 28 for tightening the band clamp. Fastener 26 may comprise any suitable element capable of attaching a lower edge of sheet 11 around the periphery of a drain pan. In preferred embodiments, fastener 26 comprises an elongated element that can be clamped around the perimeter of the drain pan. For example, fastener 26 may comprise:

- an elastic band,
- a tie strap fastener;
- a strap clamp (which may be tightened and held by means of any suitable mechanism, such as a worm gear, a buckle, a strap ratchet or the like); or
- the like.

In other embodiments, fastener 26 may be disposed between sheet 11 and the drain pan. For example, fastener 26 may comprise a suitable adhesive. Preferably, when closure 25 is closed and fastener 26 has been installed, water cannot leak out between the drain pan and jacket 10 in any significant amount. Fastener 26 is preferably of a type that has two ends are initially separate but can be coupled together so that fastener 26 encircles a drain pan.

FIG. 1 shows a plurality of loops 29 through which fastener 26 extends. Loops 29 or other means for keeping fastener 26 aligned along edge 23 facilitate installation of jacket 10 about water tank 30. Other means that may be used to keep fastener 26 aligned along edge 23 of sheet 11 include clips or a sleeve. Loops 29 or other means for keeping fastener 26 aligned along edge 23 are not present in all embodiments.

In some alternative embodiments, a lower edge of sheet 11 or a flap (not shown) affixed to sheet 11 tucks inside the drain pan to guide any free water present within jacket 10 into the drain pan. In such embodiments the fastener may comprise a series of clamps or clips that attach jacket 10 to the drain pan.

In some embodiments, sheet 11, or a flap attached to sheet 11, extends past a drain pan. In such embodiments, a drawstring or the like may be provided for gathering a lower edge of the sheet or flap beneath the drain pan so that any water collected within jacket 10 will be released beneath the drain pan. Such embodiments may be useful in cases where there is a drain located beneath the drain pan.

Figure 2:
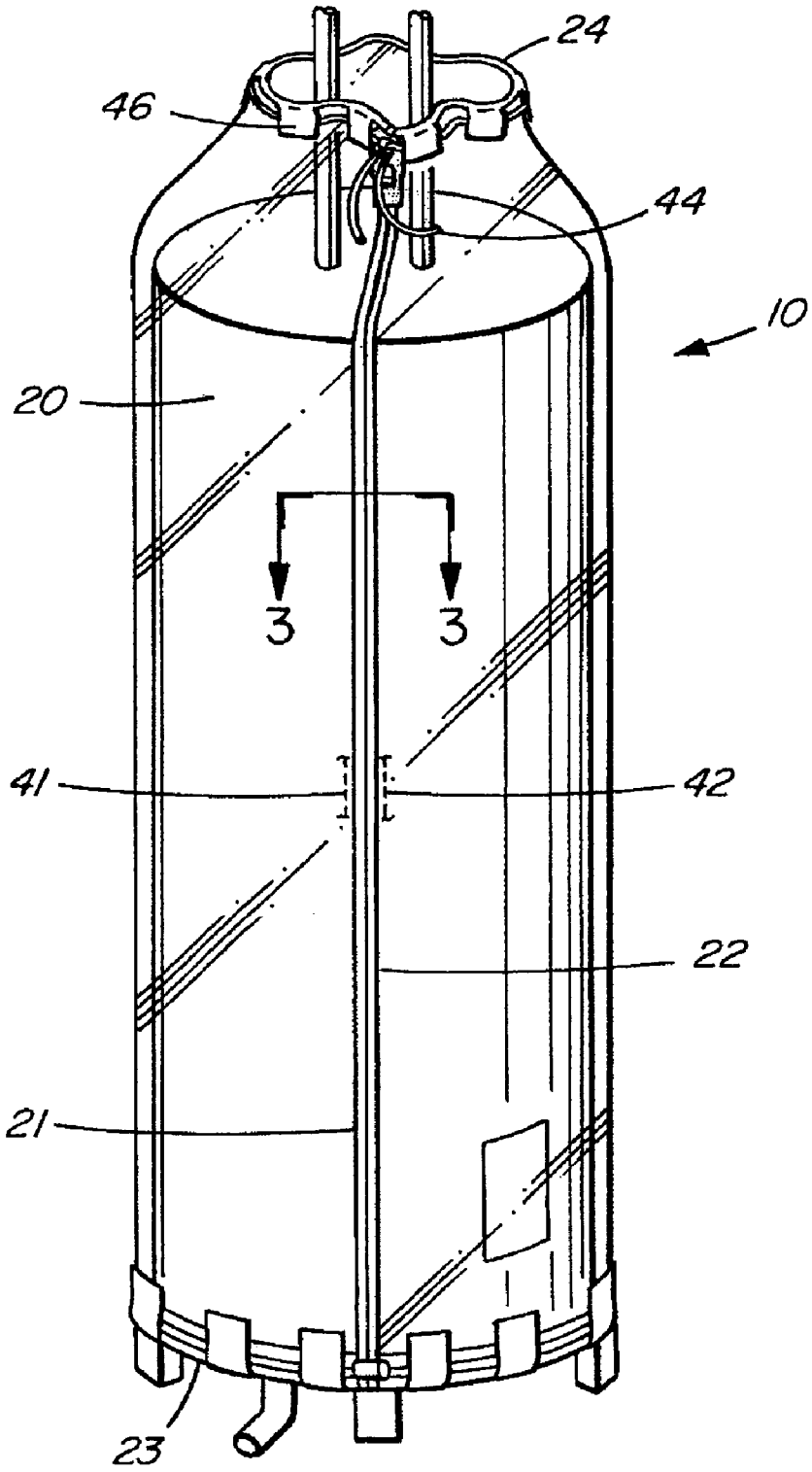
FIG. 2 is a perspective view of a jacket according to an embodiment of the invention installed around a water tank.
Figure 3:
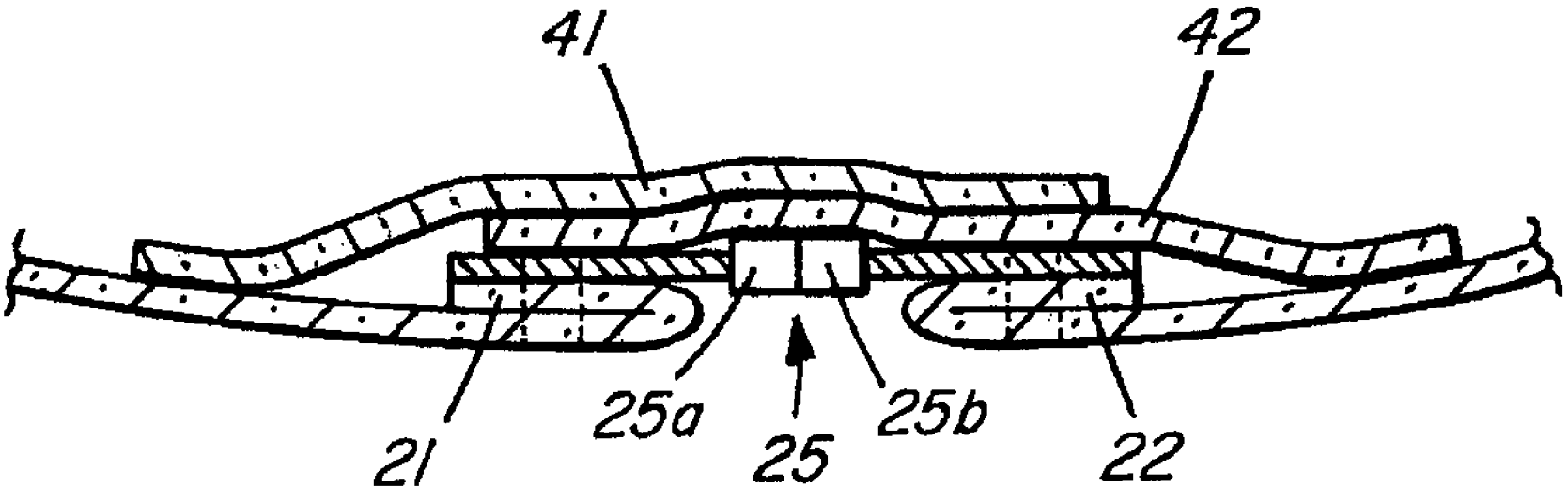
FIG. 3 is a cross-sectional view a closure of a particular embodiment that comprises first and second flaps.

As described above, it is desirable that closure 25 be water-containing. The water-containing nature of closure 25 may be provided or augmented by one or more flaps. FIGS. 2 and 3 show an embodiment in which closure 25 comprises a zipper fastener backed up by first and second flaps 41 and 42. First flap 41 extends along first edge 21. Second flap 42 extends along second edge 22.

FIG. 3 shows a cross sectional view of closure 25 in the cutting plane indicated by the line 3-3 shown in FIG. 2. Closure 25 comprises first closure element 25A attached to and extending along first edge 21 and second closure element 25B attached to and extending along second edge 22. Flap 41, which is attached to sheet 11 along a line that is close to first edge 21, is configured to overlap with closure 25. Flap 42, which is attached to sheet 11 along a line that is close to second edge 22 is configured to overlap both flap 41 and closure 25. In the illustrated embodiment, when closure 25 is closed, edge 45 of first flap 41 is wedged into the corner 47 formed between second flap 42 and second edge 22 of sheet 11. Flaps 41 and 42 may be made of a water-containing material or materials. Flaps 41 and 42 may make jacket 10 substantially watertight even in cases where closure 25 comprises a coarse zipper, a series of hooks, or another closure that is not, itself, water tight. Jacket 10 may optionally comprise flap fasteners to permit flaps 41, 42 to be fastened together. Some embodiments have only a single flap.

FIG. 2 shows a drawstring 44 extending along a fourth edge 24 of sheet 11. Drawstring 44 can be drawn up to keep the top edge of jacket 10 neatly bundled around the top of water tank 30. Further, typing up drawstring 44 as shown in FIG. 2 can prevent jacket 10 from pulling down if any water accumulates within jacket 10. The embodiment illustrated in FIG. 2 comprises loops 46 through which drawstring 44 extends. Those skilled in the art will appreciate that other means may be used to keep drawstring 44 in place around top edge 24. For example, clips or a sleeve could be used for this purpose.

Figure 4:
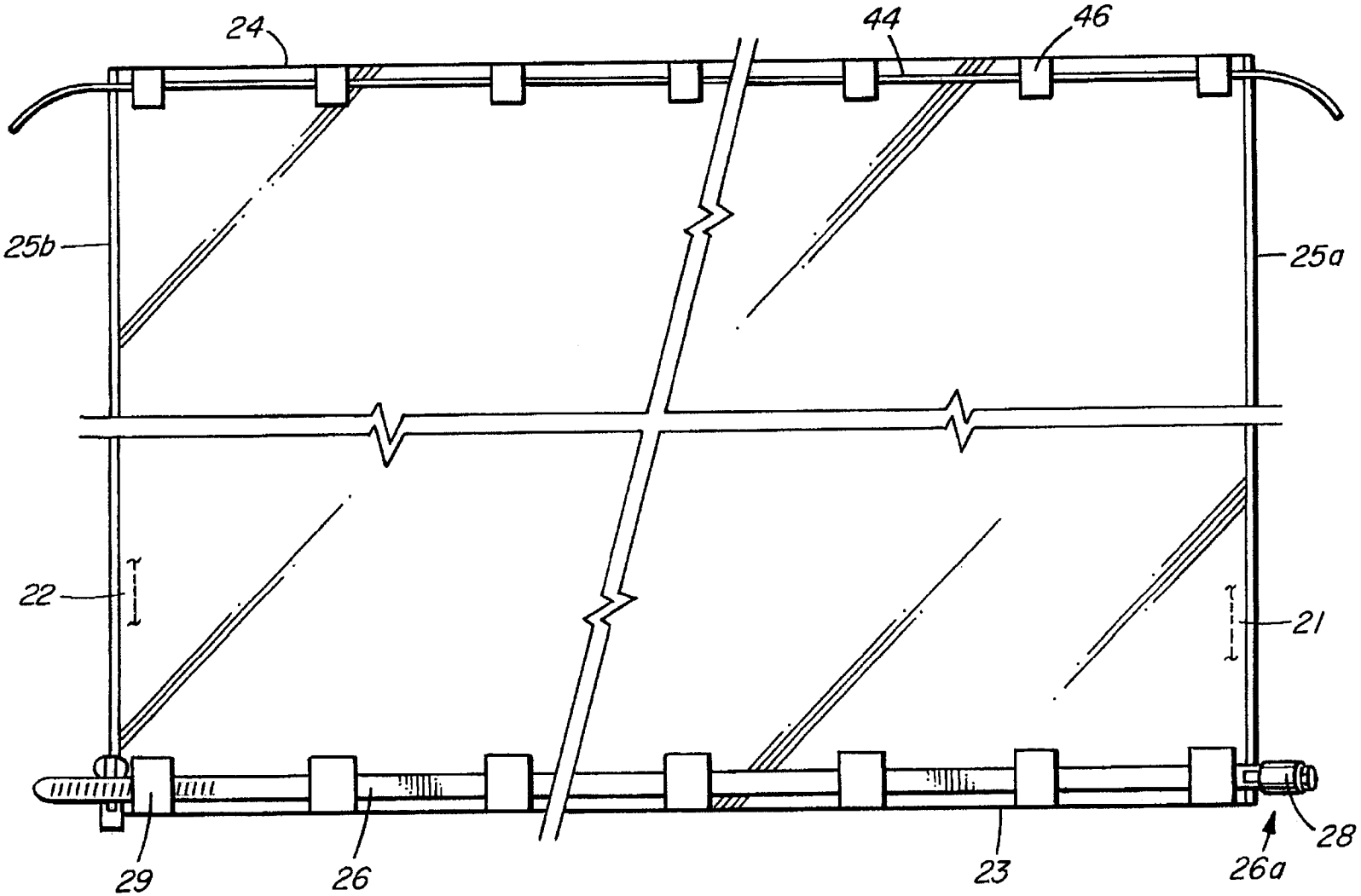
FIG. 4 is a schematic view of a jacket not installed about a water tank.

FIG. 4 shows a schematic view of a jacket in a flat configuration not yet installed about a water tank. FIG. 4 shows that sheet 11 of water-containing material has first edge 21, second edge 22, third edge 23 and fourth edge 24. Closure 25 comprises first closure element 25A and second closure element 25B that extend respectively along first edge 21 and second edge 22.

Fastener 26 extends along third edge 23 through a first plurality of loops 29 that are spaced apart along third edge 23. First end 26A of fastener 26 comprises worm gear 28. A second end 26B of fastener 26 can be coupled to first end 26A and drawn into first end 26A by operating worm gear 28. First end 26A and second end 26B of fastener 26 may be at least approximately coincident with first and second edges 21 and 22 so that jacket 10 can be wrapped around an installed water tank, such as a hot water heater with fastener 26 opened Drawstring 44 extends along fourth edge 24 through a second plurality of loops 46 that are spaced apart along fourth edge 24.

Thermal insulation (not shown) may optionally be attached to the inside or outside of sheet 11 to help to reduce heat loss from a water heater. In the alternative, sheet 11 may comprise a material that provides thermal insulation as well as being water-containing.

In a prototype embodiment, sheet 11 comprises a sheet of clear flexible plastic. A dimension of sheet 11 along third side 23 may be chosen to match the circumference of a standard-sized drip pan. For example, many hot water heaters have drip pans that are 24 inches in diameter or 22 inches in diameter. The length of sheet 11 along edges 21 and 22 may be chosen to be sufficient to reach somewhat past the top of a standard hot water heater (for example, a cylindrical hot water heater holding 40 or 60 gallons).

A jacket 10 as described herein may be retrofitted to an existing water tank without disconnecting any of the plumbing of the water tank. This may be done by:

wrapping sheet 11 around the water tank,
coupling ends 26A and 26B of fastener 26 together,
closing closure 25, and
(optionally) tightening a drawstring or the like extending along an upper edge 24 of the sheet to draw the upper edge around an upper end of the water tank.

Figure 5:
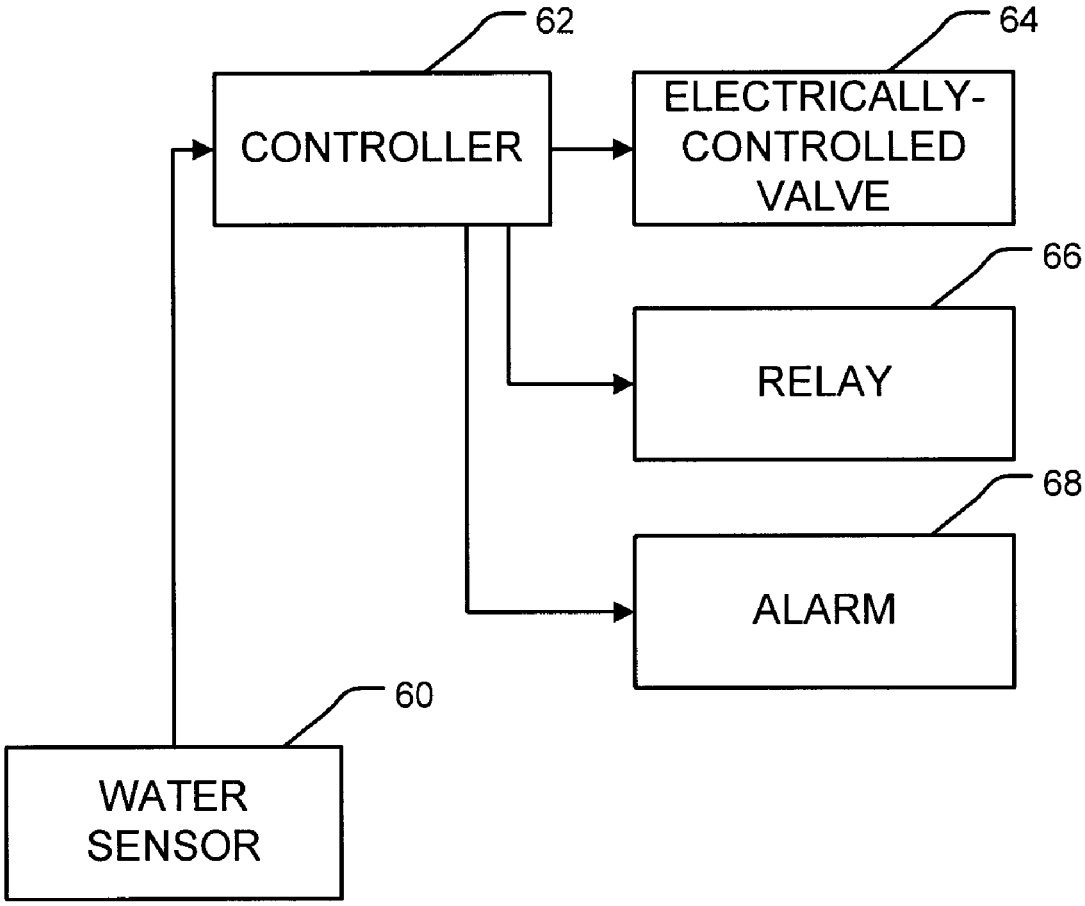
FIG. 5 is a block diagram illustrating electronic control systems that may be present in some embodiments.

Other embodiments of the invention have one or more optional features. For example, some embodiments comprise a water sensor 60 located on the inside of sheet 11. If the water tank fails and water escapes from the water tank, the water sensor will detect water in the volume between the sheet and the tank. As shown in FIG. 5, the water sensor may be connected to a controller 62 that performs one or more functions in response to the water sensor detecting water between water-containing sheet 11 and water tank 30. For example, controller 62 may control an electrically-controlled valve 64 such as a solenoid valve to shut off the supply of water to the water tank; control a relay 66 to shut of a supply of energy (typically electricity) to heating elements in the water tank; and/or control an alarm 68 that sounds locally or in a remote location to draw attention to the fact that there is a leak in the water tank. Controller 62 may be implemented, for example, by means of suitable electronic circuitry and/or programmed data processors as is understood to those skilled in the art.

Where a jacket 10 is to be used with a hot water heater having a gas-fired or oil-fired burner it may be necessary or desirable to provide a vent tube to carry combustion air to the burner.

As will be apparent to those skilled in the art, in the light of the foregoing disclosure, many alterations and modifications are possible in the practice of this invention without departing from the spirit or scope thereof. Accordingly, the scope of the invention is to be construed in accordance with the substance defined by the following claims. Those of skill in the art will recognize certain modifications, permutations, additions and sub-combinations thereof. It is therefore intended that the following appended claims and claims hereafter introduced are interpreted to include all such modifications, permutations, additions and sub-combinations as are within their true spirit and scope.

What is claimed is:

1. A jacket for a water tank, the jacket comprising a sheet of water-containing material, a closure extending along opposed first and second edges of the sheet wherein the closure has first and second parts attached respectively to and extending along opposed first and second edges of the sheet, the first and second parts of the closure being fastenable to one another and a fastener extending along a third edge of the sheet, the third edge of the sheet extending between the first and second edges of the sheet, the fastener operable to fasten the third edge of the sheet around a drain pan below the water tank, wherein a fourth edge of the sheet opposed to the third edge defines an opening around a top of the water tank when the jacket is installed on the water tank.

2. A jacket according to claim 1 wherein the closure is water-containing.

3. A jacket according to claim 1 wherein the closure comprises a zipper fastener.

4. A jacket according to claim 1 wherein the closure comprises a hook and loop fastener.

5. A jacket according to claim 1 wherein the closure comprises adhesive.

6. A jacket according to claim 1 wherein the fastener comprises a clamp having first and second ends that are connectable to clamp the third edge of the sheet around a drain pan.

7. A jacket according to claim 6 wherein the clamp comprises a band clamp.

8. A jacket according to claim 7 comprising a worm gear located at the first end of the clamp wherein the worm gear is operable to cinch and lock the second end of the clamp.

9. A jacket according to claim 1 wherein the fastener comprises adhesive.

10. A jacket according to claim 1 wherein the fastener comprises an elastic band.

11. A jacket according to claim 1 wherein the fastener comprises a tie strap fastener.

12. A jacket according to claim 1 wherein the fastener comprises a strap and a strap ratchet.

13. A jacket according to claim 1 comprising at least one loop along the third edge of the sheet wherein the fastener extends through the loop.

14. A jacket according to claim 1 comprising at least one clip along the third edge of the sheet wherein the fastener extends through the clip.

15. A jacket according to claim 1 wherein the sheet comprises a transparent area.

16. A jacket according to claim 1 wherein the sheet comprises a translucent area.

17. A jacket according to claim 1 comprising a first flap extending along the first edge of the sheet, the first flap configured to overlap the closure when the first and second edges of the sheet are joined by the closure.

18. A jacket according to claim 17 wherein the first flap is made of water-containing material and comprises a fastener operable to form a water-containing closure between the first flap and the sheet.

19. A jacket according to claim 18 comprising a second flap extending along the second edge of the sheet, the second flap configured to overlap the closure when the first and second edges of the sheet are joined by the closure.

20. A jacket according to claim 19 wherein the first and second flaps are made of water-containing material and comprise a fastener operable to form a water-containing closure between the first and second flaps.

21. A jacket according to claim 1 comprising a drawstring extending along the fourth edge of the sheet.

22. A jacket according to claim 21 comprising at least one loop located along the fourth edge of the sheet wherein the drawstring extends through the loop.

23. A jacket according to claim 1, the jacket comprising a water sensor.

24. A jacket as claimed in claim 23 comprising an alarm wherein the alarm is operatively associated with the water sensor.

25. A jacket as claimed in claim 23 comprising a mechanism for stopping the ingress of water into the tank wherein the mechanism for stopping the ingress of water into the tank is operatively associated with the water sensor.

26. A jacket according to claim 1 wherein the sheet comprises a sheet of transparent flexible plastic.

27. A jacket according to claim 1 in combination with a water tank and a drain pan below the water tank, wherein the jacket is installed around the water tank such that the third edge of the sheet is clamped around a periphery of the drain pan and the fourth edge of the sheet encircles one or more pipes projecting upwards from the water tank.

28. A jacket for a water tank, the jacket comprising:

a sheet of water-containing material, and a closure for coupling first and second opposed edges of the sheet to one another;

whereby the closure can be closed to couple the first and second edges together after the sheet has been wrapped around a water tank to provide a sleeve encircling the water tank, the sleeve having an lower aperture defined by a third edge of the sheet and a upper aperture defined by a fourth edge of the sheet, the fourth edge opposed to third edge of the sheet;

a first fastener extending along the third edge operable to attach the third edge to a drain pan; and a second fastener extending along the fourth edge operable to draw in the fourth edge around the top of the water tank.

29. A jacket according to claim 28 comprising first and second flaps extending along the first and second edges of the sheet respectively, the first and second flaps configured to overlap the closure when the first and second edges of the sheet are joined by the closure.

30. A method for installing a jacket for a water tank, the method comprising wrapping a sheet made of a water-containing material around a water tank, closing a closure extending along opposed first and second edges of the sheet, fastening a third edge of the sheet, the third edge extending between the first and second edges, around a drain pan below the water tank, and drawing in a fourth edge of the sheet around the top of the water tank, the fourth edge opposed to the third edge.

31. A method according to claim 30, the method comprising tightening a drawstring extending along the fourth edge of the sheet, the fourth edge opposed to the third edge of the sheet.

* * * * *